US005515147A

United States Patent [19]

Kenin et al.

[11] Patent Number: 5,515,147

[45] Date of Patent: May 7, 1996

[54] MECHANISM FOR SUBSTANTIALLY PREVENTING TRAIL EDGE SMEAR OF AN IMAGE ON A RECEIVER MEMBER

[75] Inventors: Michael Kenin, Rochester; Steven L. Moore, Dansville; David P. Dworzanski, Walworth; Larry T. Schlitzer, Rochester, all of N.Y.

[73] Assignee: Eastman Kodak Company, Rochester, N.Y.

[21] Appl. No.: 330,504

[22] Filed: Oct. 28, 1994

[51] Int. Cl.[6] ..... G03G 15/14

[52] U.S. Cl. ..... 355/273; 271/4.01; 355/271

[58] Field of Search ..... 355/315, 271, 355/273; 271/307, 311, 900

[56] References Cited

U.S. PATENT DOCUMENTS

| | | | |
|---|---|---|---|
| 3,457,900 | 7/1969 | Drexler | 118/637 |
| 3,615,414 | 10/1971 | Light | 96/1.6 |
| 3,620,615 | 11/1971 | Volkers | 355/32 |
| 3,893,760 | 7/1975 | Thettu | 355/315 |
| 4,014,538 | 3/1977 | Akiyama et al. | 271/308 X |
| 4,062,631 | 12/1977 | Ichikawa et al. | 355/315 |
| 4,183,658 | 1/1980 | Winthaegen | 355/212 |
| 4,279,496 | 7/1981 | Silverberg | 355/212 |
| 4,579,447 | 4/1986 | Kato | 355/311 |
| 4,627,702 | 12/1986 | Anderson | 355/212 |
| 4,630,919 | 12/1986 | Fantuzzo et al. | 355/212 X |
| 4,782,358 | 11/1988 | Shibayama et al. | 355/315 |
| 4,796,047 | 1/1989 | Fowlkes et al. | 355/277 |
| 4,797,703 | 1/1989 | Guslits | 355/212 |
| 4,806,991 | 2/1989 | Guslits | 355/212 |
| 4,980,722 | 12/1990 | Ibuchi | 355/212 |
| 5,101,238 | 3/1992 | Creveling et al. | 355/271 |
| 5,130,752 | 7/1992 | Morishita et al. | 355/274 |
| 5,138,396 | 8/1992 | Satou et al. | 355/308 |
| 5,142,338 | 8/1992 | Malinaric et al. | 355/271 |
| 5,200,782 | 4/1993 | Castelli et al. | 355/212 |
| 5,235,397 | 8/1993 | Van Der Sterren | 355/315 |
| 5,239,351 | 8/1993 | Mahoney | 355/315 |
| 5,282,010 | 1/1994 | Popovic | 355/315 |

*Primary Examiner*—Matthew S. Smith
*Attorney, Agent, or Firm*—Lawrence P. Kessler

[57] ABSTRACT

In an electrostatographic reproduction apparatus, a mechanism which substantially prevents trail edge smear of an image on a receiver member. The reproduction apparatus has a flexible dielectric web entrained over at least a pair of support members defining a web travel path. Successive areas of the dielectric web are adapted to respectively carry a marking particle developed image. A marking particle developed image is transferable from the dielectric web to a receiver member brought into contact with the dielectric web. After transfer of the developed image to the receiver member, the receiver member is transported away from the dielectric web. A mechanism is provided for facilitating separation of a receiver member from the dielectric web. The separation mechanism includes an elongated member having a surface adapted to enable the dielectric web to pass thereover. The elongated member is positioned to engage the dielectric web along a line of contact transverse to the direction of travel of the dielectric member along the web travel path, downstream of the transfer means and upstream of the transport means to separate the receiver member from the dielectric web closer to the transfer means, and dampen perturbations in the dielectric web, whereby trail edge smear of an image on a receiver member is substantially prevented.

9 Claims, 2 Drawing Sheets

FIG. 3
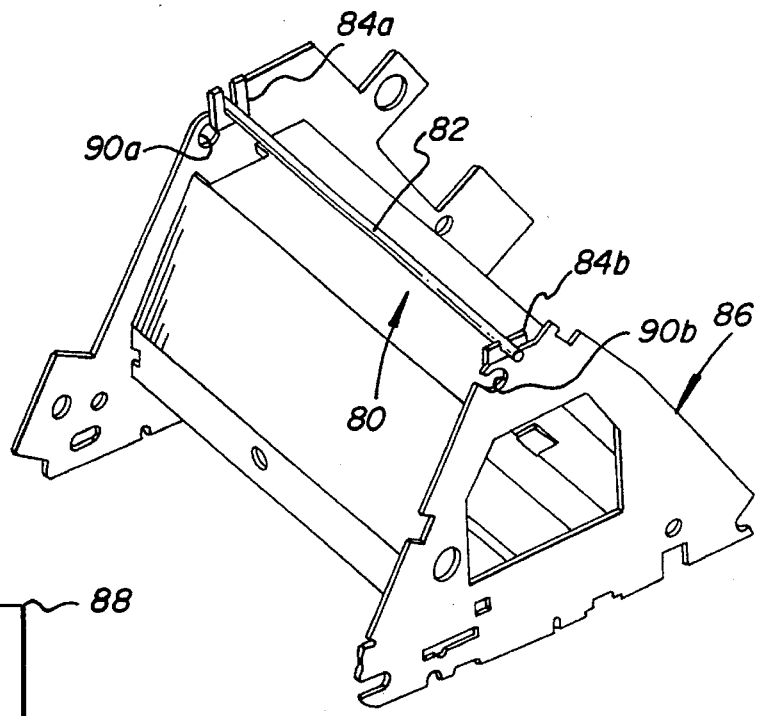
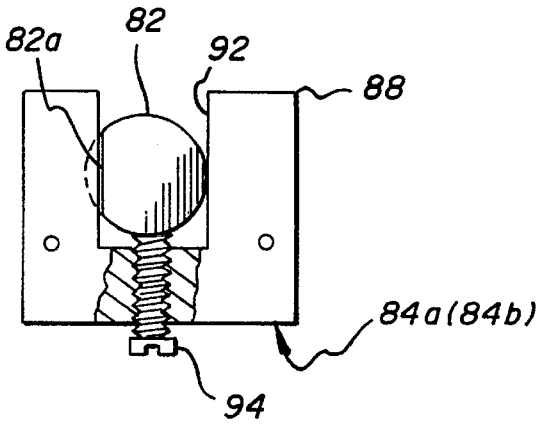
FIG. 4
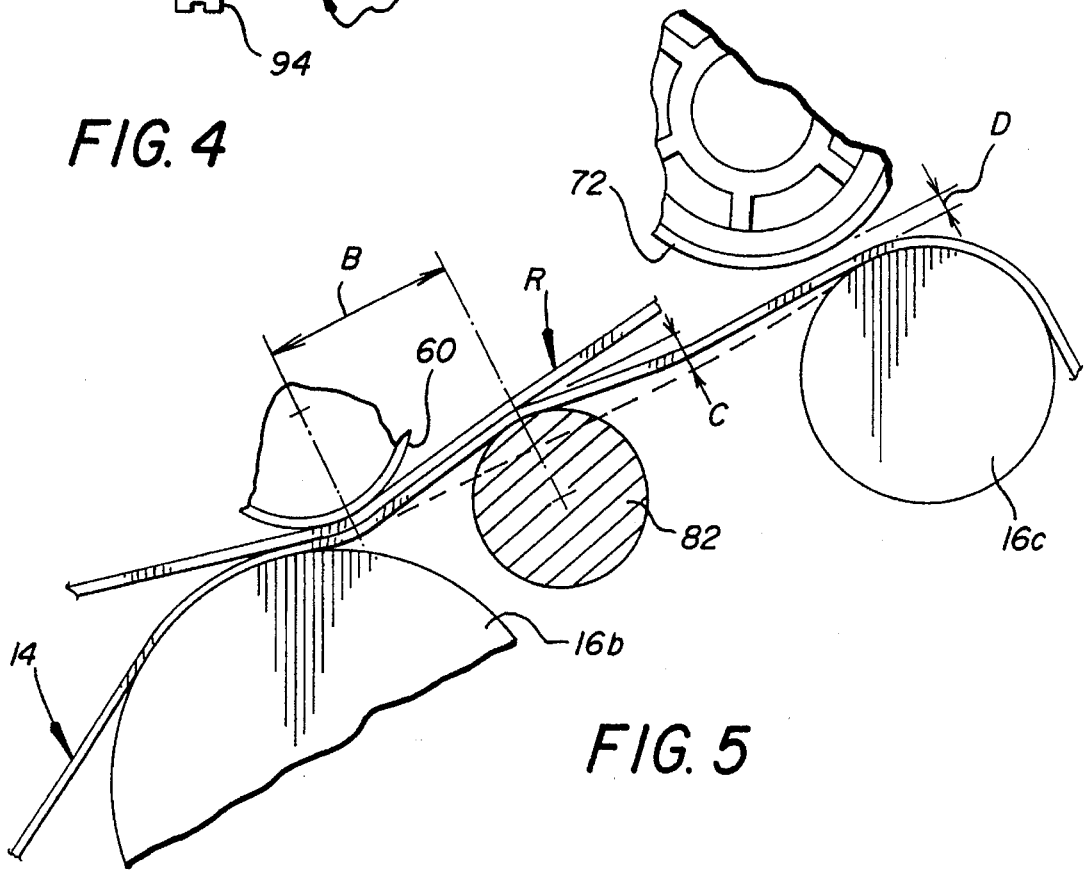
FIG. 5

MECHANISM FOR SUBSTANTIALLY PREVENTING TRAIL EDGE SMEAR OF AN IMAGE ON A RECEIVER MEMBER

BACKGROUND OF THE INVENTION

The present invention relates in general to preventing trail edge smear of an image produced by an electrostatographic reproduction apparatus, on a receiver member, and more particularly to a mechanism for facilitating separation of a receiver member from the dielectric web of an electrostatographic reproduction apparatus in a manner to substantially prevent trail edge smear of an image on such receiver member.

In typical commercial electrostatographic reproduction apparatus (copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by an electrically biased roller, is applied to transfer the marking particle developed image to the receiver member from the dielectric member. After transfer, the receiver member bearing the transferred image is separated from the dielectric member and transported away from the dielectric member to a fuser assembly at a downstream location. There the image is fixed to the receiver member by heat and/or pressure from the fuser assembly to form a permanent reproduction thereon.

It has been found that electrostatographic reproduction apparatus of the above described type, at times, exhibit a defect observable in image quality where the image over the trail edge of the receiver member is smeared. It was generally believed that this particular image defect was caused when the lead edge of the receiver member entered the fuser assembly with the trail edge beyond the transfer roller nip. However, manipulation of related electrostatographic process characteristics, vector velocities of the receiver member, pre-transfer vacuum transport, and fuser assembly to reduce this image defect manifestation have resulted in only a slight improvement thereof.

SUMMARY OF THE INVENTION

In view of the foregoing discussion, this invention is directed to a mechanism, in an electrostatographic reproduction apparatus, which substantially prevents trail edge smear of an image on a receiver member. The reproduction apparatus has a flexible dielectric web entrained over at least a pair of support members defining a web travel path. Successive areas of said dielectric web are adapted to respectively carry a marking particle developed image. A marking particle developed image is transferable from the dielectric web to a receiver member brought into contact with the dielectric web. After transfer of the developed image to the receiver member, the receiver member is transported away from the dielectric web. A mechanism is provided for facilitating separation of a receiver member from the dielectric web. The separation mechanism comprises an elongated member having a surface adapted to enable the dielectric web to pass thereover. The elongated member is positioned to engage the dielectric web along a line of contact transverse to the direction of travel of the dielectric member along the web travel path, downstream of the transfer means and upstream of the transport means to separate the receiver member from the dielectric web closer to the transfer means, and dampen perturbations in the dielectric web, whereby trail edge smear of an image on a receiver member is substantially prevented.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 3 is a view, in perspective, of the core of the reproduction apparatus for supporting the dielectric web and the separation mechanism shown in FIG. 1;

FIG. 4 is a side elevational view, on an enlarged scale, of the support for the mechanism for facilitating separation of the receiver member from the dielectric web according to this invention; and FIG. 5 is a side elevational view, in cross-section and on an enlarged scale, of a receiver member during separation from the dielectric web under the influence of the separation mechanism shown in FIG. 1.

DETAILED DESCRIPTION OF THE INVENTION

Figure 1:
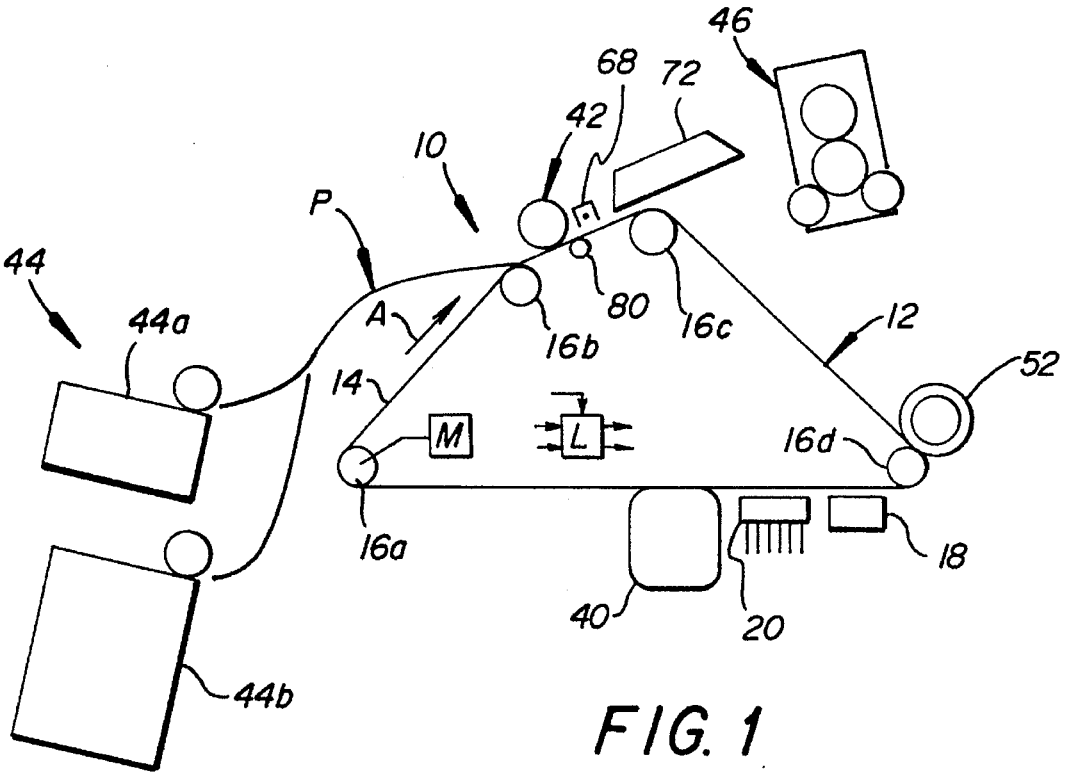
FIG. 1 is a schematic illustration of an electrostatographic reproduction apparatus including a transfer mechanism for simultaneous duplex transfer, according to, is invention.

Referring now to the accompanying drawings, an exemplary electrostatographic reproduction apparatus 10 is schematically shown in FIG. 1. The reproduction apparatus 10 includes a dielectric member 12 which is preferably an endless dielectric web 14 supported by rollers 16*a*–16*d*. One of the rollers (e.g. roller 16*a*) is driven by motor M to move the web about a closed loop path in the direction of arrow A. The web 14 is a composite structure having a photoconductive surface layer with a plurality of image receiving areas and a grounded conductive support layer such as shown for example in U.S. Pat. No. 3,615,414 (issued Oct. 26, 1971 in the name of Light). Typical electrographic process stations for forming transferable marking particle images on the web 14 are located about the periphery of the web in operative relation with the image receiving areas thereof.

Control of the reproduction apparatus 10 and the electrographic process stations are accomplished by a logic and control unit L including a microprocessor for example. The microprocessor receives operator input signals and timing signals, for example from sensors (not shown) detecting movement of the web 14 about its closed loop path. Based on such signals and a program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

The electrographic process stations function in the following manner. A corona charger 18, coupled to a D.C. or biased A.C. electrical potential source (not shown), applies a uniform electrostatic charge to the web 14 as it moves past the charger. The uniform charge, in an image receiving area of the web, is altered as the web passes through an exposure zone to form an image-wise change pattern in such area corresponding to information to be copied. For example, the image-wise charge pattern is formed by exposure of the image-receiving area of the web to a light image of such information produced electronically, for example by an LED array (shown schematically as element 20) or laser scanner. 0f course, depending upon the composition of the dielectric web and the marking particles and the desired duty cycle for the electronic exposure mechanism, the image-wise charge pattern may result from exposure of the given area of the web to that which is to represent the background of the information to be copied or exposure of the given area of the web to that which is to represent the particular information. The formation of a described image-wise charge pattern on the web may be alternately accomplished by other suitable methods such as by exposure to reflected light images.

As the web moves about its path, the area bearing the image-wise charge pattern is brought into operative relation with a developer station 40. The developer station 40 is for example a magnetic brush such as described in U.S. Pat. No. 3,457,900 (issued Jul. 29, 1969 in the name of Drexler). The magnetic brush brings pigmented marking particles, electroscopically charged to a polarity opposite to that of the imagewise charge pattern on the web 14, into contact with the moving web. Such particles will then adhere to the image-wise charge pattern to develop the pattern on the web and form a transferable image.

The image-receiving area of the web 14 containing the transferable image travels about the closed loop path to a transfer station 42 coupled to a D.C. or biased A.C. electrical potential source for example. A receiver member (designated in the drawings by the letter R), such as a sheet of plain paper, is fed from a supply hopper 44 (plural supplies 44*a* and 44*b* may be used to contain sheets of different characteristics or dimensions). Such receiver member is transported along a path P to the transfer station 42 in timed relation with the moving web 14 so that the receiver member is in register with the transferable image carried by the web. The transfer station 42 includes, for example, an electrically biased transfer roller 60, such as described in US Pat. No. 5,101,238 (issued Mar. 31, 1992, in the name of Creveling, et al). The transfer roller 60 establishes an electrostatic field to effect transfer of the transferable image from the web 14 to the receiver member.

After transfer of the transferable image to the receiver member, the receiver member is separated from the web 14 and transported by assembly 72 along a continuation of path P to a fuser assembly 46 where the transferred image is fixed to such member, for example by heat and/or pressure. After the transferred image is fixed to the receiver member, the member is directed along a path to an output hopper (not shown) for operator retrieval. Substantially simultaneously with transport of the receiver member through the fuser 46, the utilized image-receiving area of the web 14 moves through a cleaning station 52 where residual (non-transferred) marking particles are removed, for example by a rotating fiber brush, and returned to the area of the charger 18 to be conditioned (uniformly charged) for reuse.

Figure 2:
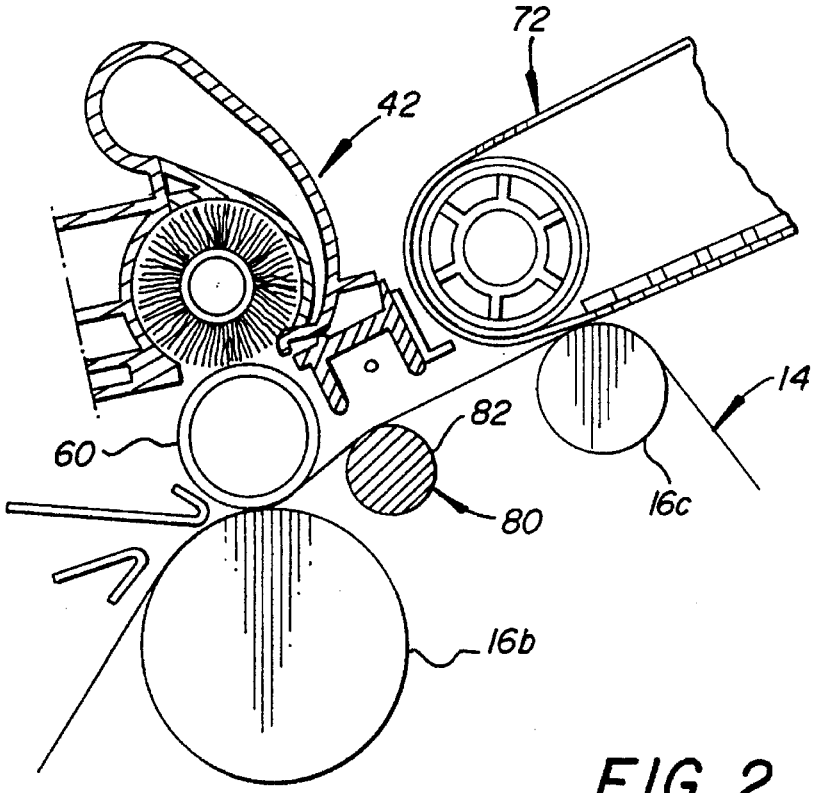
FIG. 2 is a side elevational view, on an enlarged scale and partly in cross-section, of a portion of a reproduction apparatus including a dielectric web, an assembly for transferring an image from the dielectric web to a receiver member, and a mechanism for facilitating separation of the receiver invention.

In order to facilitate separation of a receiver member from the dielectric web 14 of the exemplary reproduction apparatus 10, so as to substantially prevent the above-described trail edge smear image defect, a mechanism 80 is provided according to this invention. The mechanism 80 includes an elongated bar 82 of substantially circular cross-section (see FIG. 2). It is, of course, understood that the bar 82 could be of any other suitable curvilines configuration, such as a radiused bar (of less than circular cross-section a ski or ramp for example, which would accurately locate the line of separation for the receiver member from the dielectric web according to this invention.

As best shown in FIGS. 3 and 4, the bar 82 is supported at its ends in locating members 84*a*, 84*b* carried by the core assembly 86 for the reproduction apparatus. The locating members respectively include a bracket 88 attached to the core assembly 86 adjacent to the mounting features 90*a*, 90*b* for the web support roller 16*b*. The bracket 88 has a slot 92 adapted to receive a flatted portion 82*a* of the bar 82 to prevent the bar from rotating in the slot. Additionally, the location of the edge of the slot engaged by the flatted portion 82*a* of the bar 82 is selected to position the bar a predetermined distance from the transfer roller 60. That is, parallel planes taken respectively through the longitudinal axes of the bar 82 and the transfer roller 60 are at a distance designated as B in FIG. 5. Such distance B, as shown, is sibstantially upstream of the assembly 72. To accurately locate the bar relative to the transfer roller, it has been found that the dimension for the distance B is in the range of approximately 0,254 cm to 0.762 cm.

Further, an adjustment screw 94 carried by the respective brackets 88 for each of the locating members 84*a*, 84*b*, engages the bar 82 and serves to enable the bar to be accurately located in a direction perpendicular to the longitudinal axis of the bar and toward (or away from) the path described by travel of the dielectric web 14 between the transfer roller 60 and the support roller 16c. This will, in turn, set the distance of penetration of the surface of the bar into intercepting relation with such travel path described by the web 14, designated as C in FIG. 5. It has been found that the dimension for the distance C is in the range of approximately 0,008 cm to 0,305 cm.

As an added aspect of preventing the trail edge smear image defect, the spacing of the web 14 to the transport assembly 72 is also set to be a predetermined distance, designated as D in FIG. 5. The dimension for the distance D is in the range of approximately 0,015 cm to 0,508 cm. It has been found that, to facilitate release of the receiver sheet from the dielectric web 14 and substantially prevent the trail edge smear image defect, the dimension for the distance B is preferably is 0.762 cm, the dimension for the distance C is preferably is 0,229 cm, and the dimension for the distance D is preferably is 0.508 cm.

The invention has been described in detail with particular reference to preferred embodiment thereof, but it will be understood that variations and modifications can be effected within the spirit and scope of the invention as set forth in the claims.

What is claimed is:

1. In an electrostatographic reproduction apparatus having a flexible dielectric web entrained over at least a pair of support members defining a web travel path, successive areas of said dielectric web adapted to respectively carry a making particle developed image, means for transferring a marking particle developed image from said dielectric web to a receiver member brought into contact with said dielectric web, and means for separating and transporting a receiver member away from said delectric web after transfer of the developed image to said receiver member, a mechanism for facilitating separation of a receuver member from said dielectric web, said separation facilitating mechanism comprising:

an elongated member having a curvilinear surface adapted to enable said dielectric web to pass thereover, and means for positioning said elongated member to engage said dielectric web along a line of contact transverse to the direction of travel of said dielectric member along said web travel path, diwnstream of said transfer means and a substantial distance upstream of said separation and transport means to separate said receiver member from said dielectric web closer to said transfer means, and dampen perturbations in said dielectric web, whereby trail edge smear of an image on a receiver member is substantially prevented.

2. The separation mechanism according to claim 1 wherein said bar is substantially circular in cross-section.

3. The separation mechanism according to claim 1 wherein said positioning means locates said elongated member from said transfer means in the range of approximately 0.254 cm to 0.762 cm.

4. The separation mechanism according to claim 3 wherein said positioning means locates said elongated member 0.762 cm from said transfer means.

5. The separation mechanism according to claim 1 wherein said positioning means locates said elongated member in interference with the travel path of said dielectric web in the range of approximately 0.008 cm to 0.305 cm.

6. The separation mechanism according to claim 5 wherein said positioning means locates said elongated member in 0.229 cm interference with the travel path of said dielectric web.

7. The separation mechanism according to claim 1 wherein said positioning means provides for a dielectric web-to-separation and transport means spacing in the range of approximately 0.015 cm to 0.508 cm.

8. The separation mechanism according to claim 7 wherein said positioning means provides for a dielectric web-to-separation and transport means spacing of 0.508 cm.

9. The separation mechanism according to claim 1 wherein said positioning means locates said elongated member approximately 0.762 cm from transfer means; in approximately 0.229 cm interference with the travel path of said dielectric web; and with an approximate dielectric web-to-separation and transport means spacing of 0.508 cm.

* * * * *